US009010557B2

(12) United States Patent
Stempel

(10) Patent No.: US 9,010,557 B2
(45) Date of Patent: Apr. 21, 2015

(54) COMMEMORATIVE HOLLOW-STEM VESSELWARE

(71) Applicant: Thomas Conrad Stempel, Seattle, WA (US)

(72) Inventor: Thomas Conrad Stempel, Seattle, WA (US)

(73) Assignee: Thomas Conrad Stempel, Seattle, WA (US)

( * ) Notice: Subject to any disclaimer, the term of this patent is extended or adjusted under 35 U.S.C. 154(b) by 0 days.

(21) Appl. No.: 14/106,521

(22) Filed: Feb. 7, 2014

(65) Prior Publication Data

US 2014/0197128 A1 Jul. 17, 2014

Related U.S. Application Data

(60) Provisional application No. 61/765,763, filed on Feb. 17, 2013.

(51) Int. Cl.
*A47G 19/22* (2006.01)
*B65D 13/02* (2006.01)

(52) U.S. Cl.
CPC ..... *A47G 19/2227* (2013.01); *B65D 13/02* (2013.01)

(58) Field of Classification Search
CPC . A47G 19/2227; A47G 19/2205; B65D 13/02
USPC ..... 215/374, 377, 376, 372, 386
See application file for complete search history.

(56) References Cited

U.S. PATENT DOCUMENTS

| | | | | | |
|---|---|---|---|---|---|
| 4,872,569 | A * | 10/1989 | Bolte | ..... | 215/12.1 |
| 5,070,435 | A * | 12/1991 | Weller | ..... | 362/101 |
| 5,402,907 | A * | 4/1995 | Liu | ..... | 220/502 |
| 2007/0257048 | A1 * | 11/2007 | Towery et al. | ..... | 220/703 |

* cited by examiner

*Primary Examiner* — Stephen Castellano

(57) ABSTRACT

Product is a commemorative and/or functional drinking vessel of any size that contains thematic emblems, imagery, graphics, and labels displayed on the cup, with associated thematic objects contained within a hollow stem of any diameter or length. Hollow-stem vesselware is defined as any vessel that is supported by a hollow stem with thematic object and foot. This iconic work is a memorable souvenir, award, or gift for people of all walks of life, and can be custom-designed to meet any customer need. The hollow stem containing thematic objects is not found within any other market with such style and poise. This item lends instant class and character to any event or memorabilia collection.

3 Claims, 8 Drawing Sheets

COMMEMORATIVE HOLLOW-STEM VESSELWARE

This application claims benefit to provisional application No. 61/765,763, filed Feb. 17, 2013.

STATEMENT OF FEDERALLY-SPONSORED RESEARCH

Not Applicable

BACKGROUND

Thomas Stempel formulated the idea for Commemorative Hollow-Stem Vesselware after serving in Iraq. Upon return from deployment in 2011, Mr. Stempel—who owns his own glass-blowing studio—formed the prototype with a 7.62 mm ball round. The round was too heavy for the glass, and the second iteration was made of a plastic replica that was electro-plated to look like the genuine article. Subsequent productions featured additional thematic items and logos that appeal to a wide variety of customers.

DESCRIPTION OF VESSEL AS LABELED IN MECHANICAL DRAWINGS (DIMENSIONS WILL VARY BASED ON CUSTOMER REQUEST AND PRODUCT VARIATION)

Figure 1:
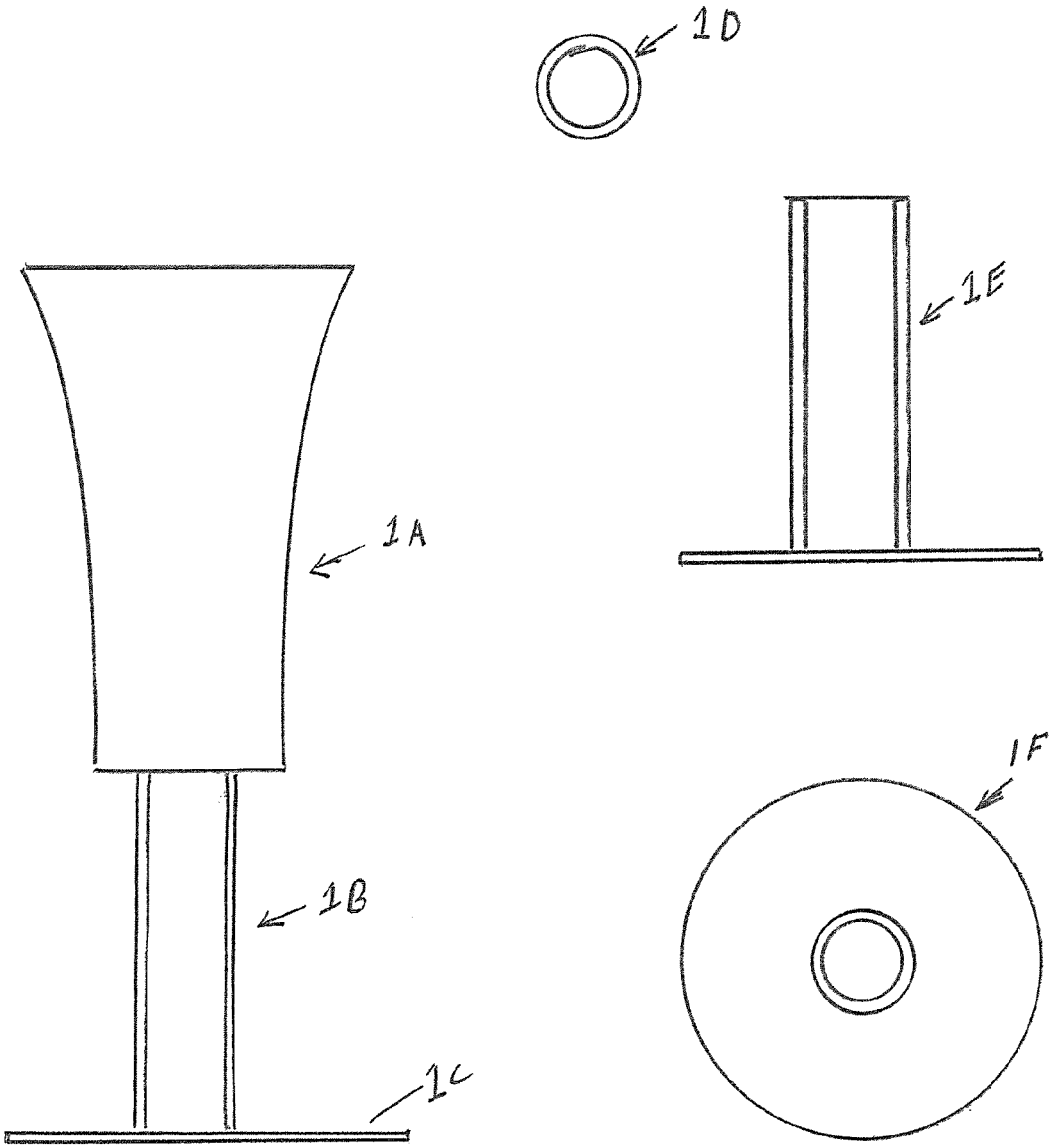
Figure 2:
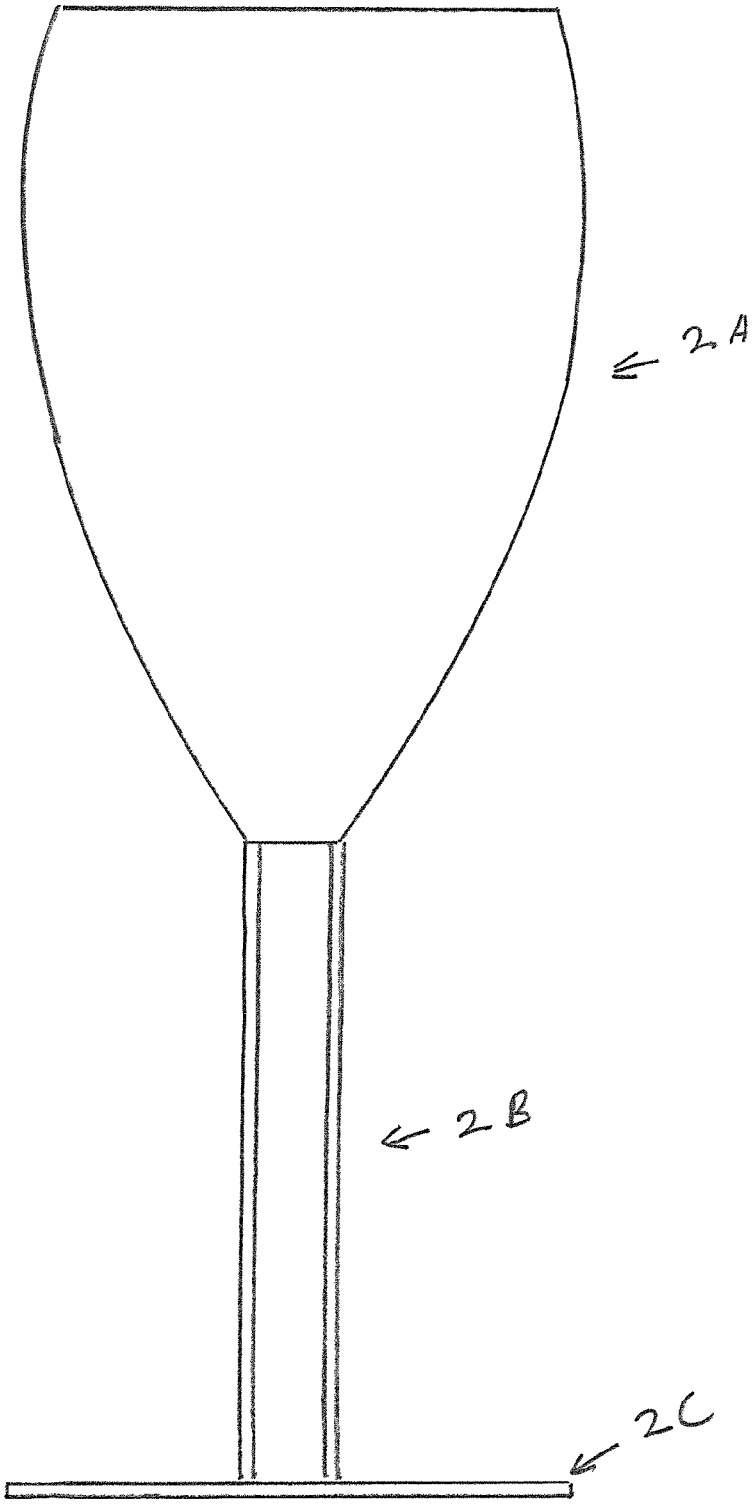
Figure 3:
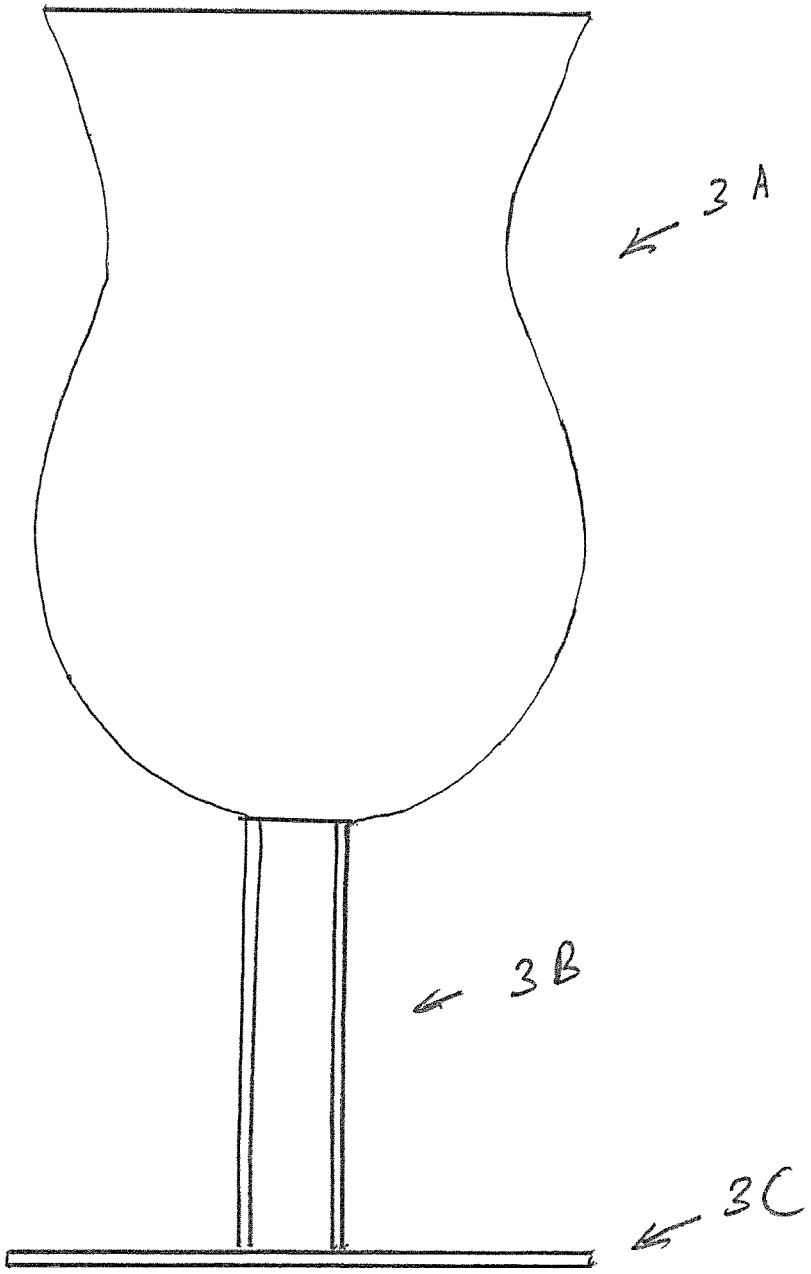
Figure 4:
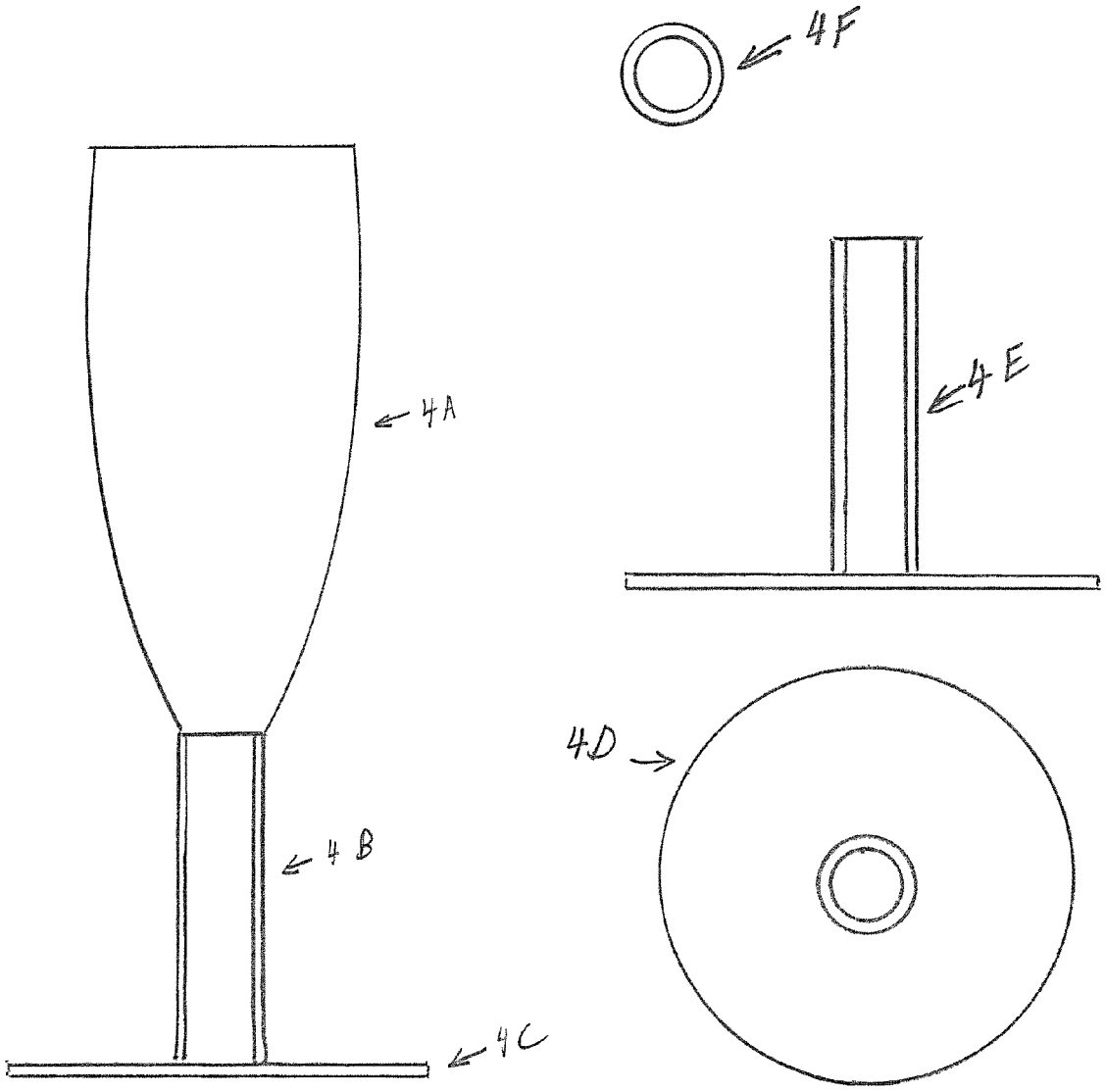
Figure 5:
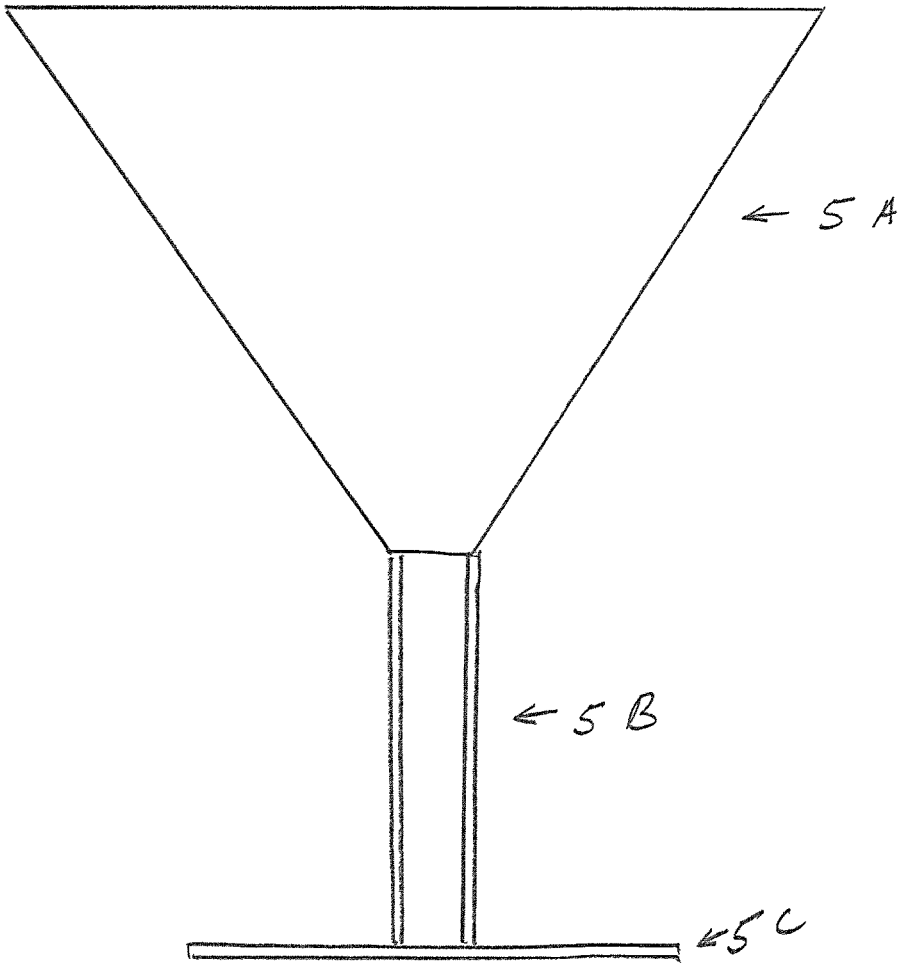
Figure 6:
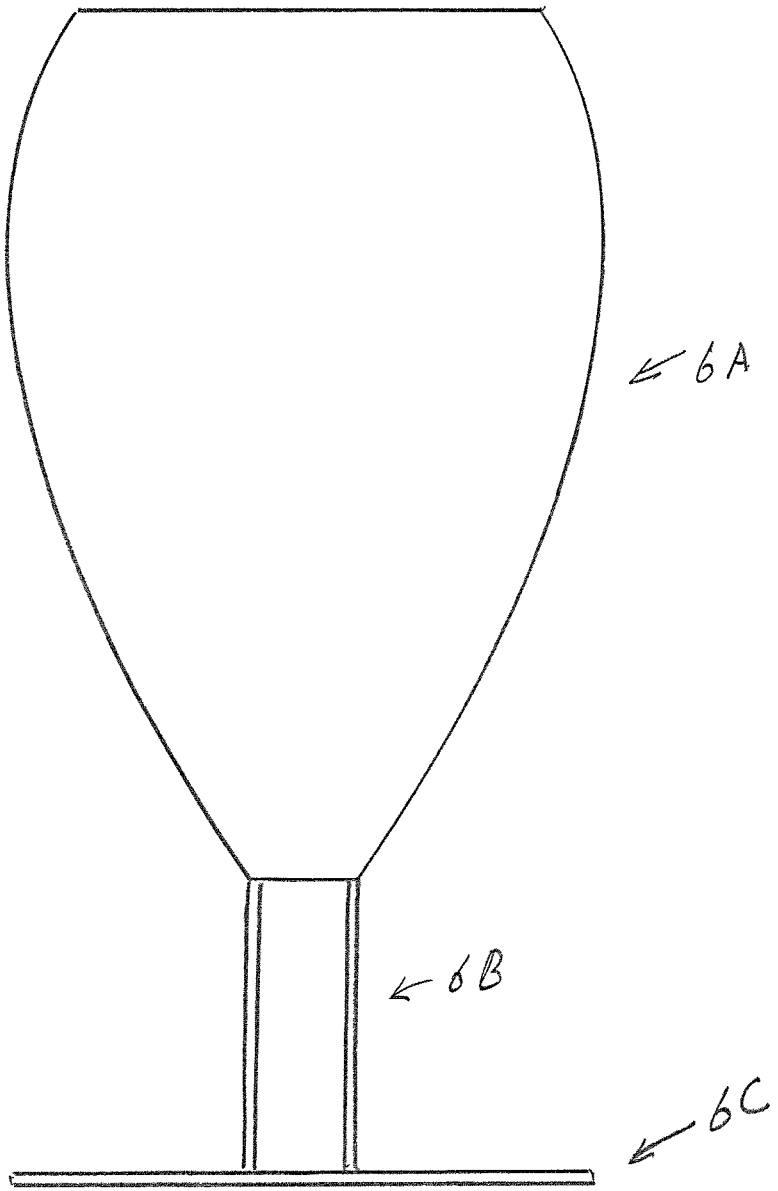
Figure 7:
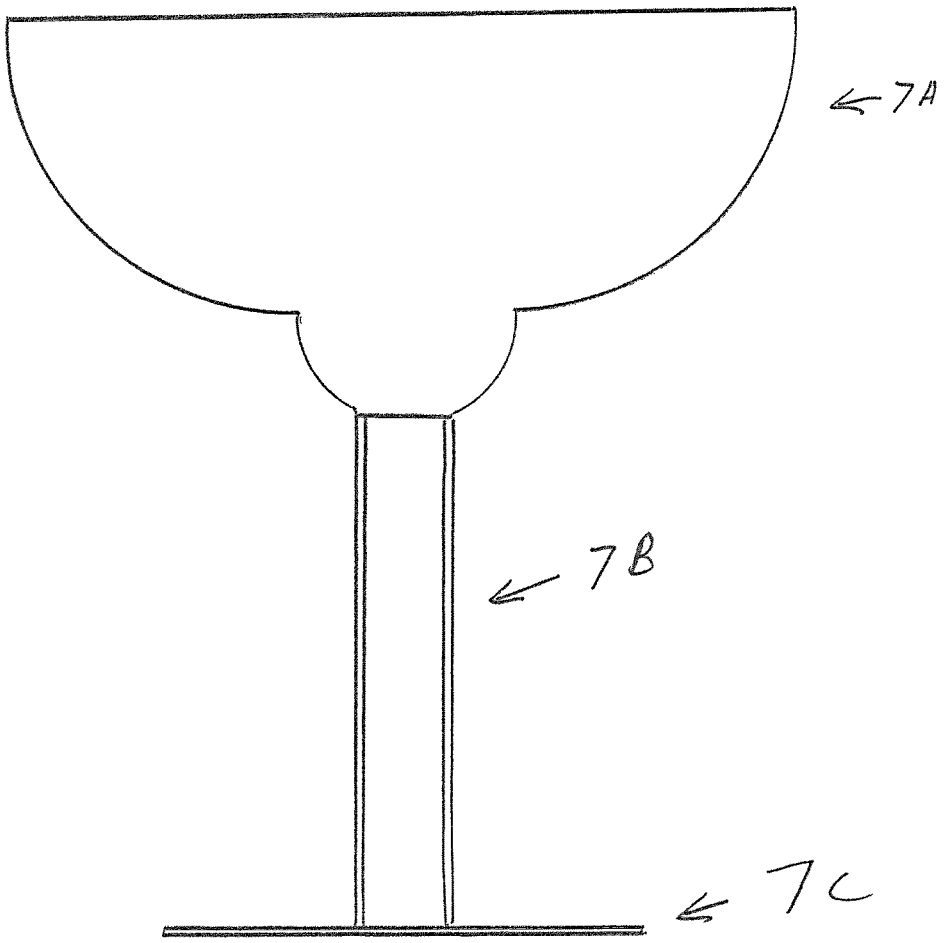
Figure 8:
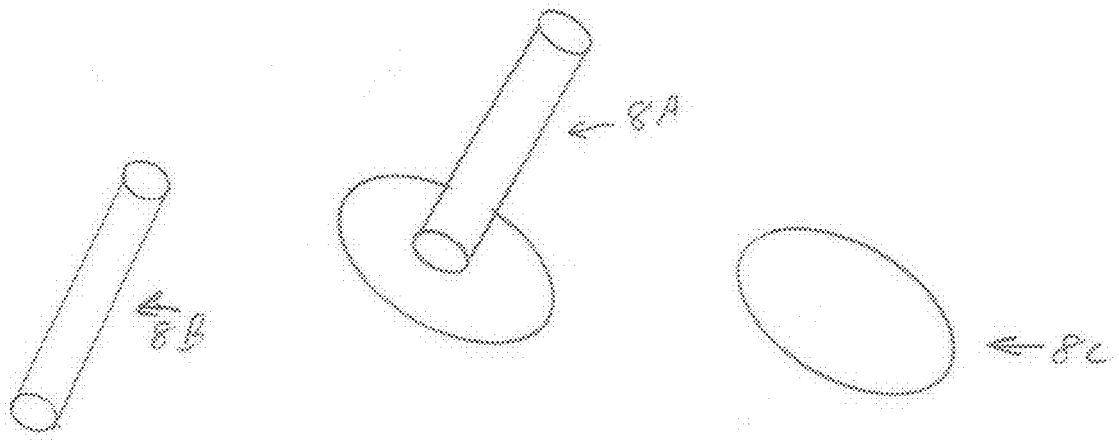

FIG. 1—Standard shot glass
1A—Cup (1.75 ounce reservoir)
1B—Hollow stem
1C—Foot
* 1A, 1B, & 1C together comprise the side view of the completed product
1D—Top view—Hollow stem
1E—Side view—Hollow stem and foot
1F—Top view—Hollow stem and foot
** Dimensions will vary based on customer request and product variation
FIG. 2—Standard wine glass
2A—Cup
2B—Hollow stem
2C—Foot
* 2A, 2B, & 2C together comprise the side view of the completed product
** Dimensions will vary based on customer request and product variation
FIG. 3—Hurricane glass
3A—Cup
3B—Hollow Stem
3C—Foot
* 3A, 3B, & 3C together comprise the side view of the completed product
** Dimensions will vary based on customer request and product variation
FIG. 4—Champagne flute
4A—Cup
4B—Hollow Stem
4C—Foot
* 4A, 4B, & 4C together comprise the side view of the completed product
4D—Top view—Hollow stem and foot
4E—Side view—Hollow stem and foot
4F—Top view—Hollow stem
 Dimensions will vary based on customer request and product variation FIG. 5**—Martini glass
5A—Cup
5B—Hollow Stem
5C—Foot
* 5A, 5B, & 5C together comprise the side view of the completed product
** Dimensions will vary based on customer request and product variation
FIG. 6—Rounded cocktail glass
6A—Cup
6B—Hollow Stem
6C—Foot
* 6A, 6B, & 6C together comprise the side view of the completed product
** Dimensions will vary based on customer request and product variation
FIG. 7—Margarita glass
7A—Cup
7B—Hollow Stem
7C—Foot
* 7A, 7B, & 7C together comprise the side view of the completed product
** Dimensions will vary based on customer request and product variation
FIG. 8—Perspective view of completed stem, foot, and related parts
8A—Perspective view of completed foot and stem
8B—Hollow stem
8C—Foot
** Dimensions will vary based on customer request and product variation

DETAILED DESCRIPTION

01. Product is a commemorative and/or functional drinking vessel of any size that contains thematic emblems, imagery, graphics, and labels displayed on the cup, with associated thematic objects contained within a hollow stem of any diameter or length. Hollow-stem vesselware is defined as a vessel of any material that is supported by a hollow stem and foot with thematic object.

02. Product is made of molded pieces that are chemically bonded together with industrial adhesive. Thematic objects in the stem are placed within the stem prior to the cup being attached to the foot and stem. Logos and emblems are enamel-painted or etched to withstand washing in dishwashers or hot liquid without loss of color or definition. Thematic objects within the hollow stem may be made of plastic or metal, and complement the theme of the design motif for aesthetic effect.

03. Product is safe to be used for consumption of liquids. Product contains no lead or other harmful materials, and is FDA approved for drinking.

The invention claimed is:

1. A commemorative hollow-stem vesselware is defined as a drinking vessel, said vessel is comprised of molded glass or other moldable material including a cup, a hollow stem and a foot, said cup having a beverage retaining cavity, said cup is chemically bonded together with industrial adhesive to said hollow stem and said foot, said hollow stem including an interior chamber, wherein thematic imagery is displayed on said cup and at least one corresponding thematic object of proportionate size to the interior chamber of said hollow stem is sealed by said cup and said foot within said hollow stem, the beverage retaining cavity is separated from the interior chamber such that beverage doesn't enter the interior chamber.

2. The vesselware of claim 1, wherein the thematic imagery is a logo or emblem applied as a label or enamel-painted or etched to said cup.

3. The vesselware of claim 1, wherein the at least one corresponding thematic object is made of plastic, metal or combinations of plastic and metal.

* * * * *